United States Patent [19]

Norton

[11] Patent Number: 4,538,366

[45] Date of Patent: Sep. 3, 1985

[54] ATHLETIC SHOE WITH RIDGED OUTSOLE

[75] Inventor: Daniel E. Norton, Hampton, N.H.

[73] Assignee: Nike, Inc., Beaverton, Oreg.

[21] Appl. No.: 526,815

[22] Filed: Aug. 26, 1983

[51] Int. Cl.[3] ..... A43B 13/04

[52] U.S. Cl. ..... 36/32 R; 36/59 C; D2/320

[58] Field of Search ..... 36/115, 32 R, 59 C, 36/59 R, DIG. 320, 34, 114, 129, 134, 30 R, 59 A, 67 A

[56] References Cited

U.S. PATENT DOCUMENTS

| | | | |
|---|---|---|---|
| D. 253,257 | 10/1979 | Pasquier | 320/309 |
| 4,098,011 | 7/1978 | Bowerman | 36/129 |
| 4,130,947 | 12/1978 | Denu | 36/30 |
| 4,281,467 | 8/1981 | Anderie | 36/32 R |
| 4,307,521 | 12/1981 | Inohara et al. | 36/59 C X |
| 4,364,190 | 12/1982 | Yonkers | 36/32 |
| 4,378,643 | 4/1983 | Johnson | 36/129 |
| 4,439,936 | 4/1984 | Clarke et al. | 36/32 R X |

FOREIGN PATENT DOCUMENTS

| | | | |
|---|---|---|---|
| 186039 | 5/1906 | Fed. Rep. of Germany | 36/59 R |
| 1093702 | 1/1959 | Fed. Rep. of Germany . | |
| 2239077 | 8/1972 | Fed. Rep. of Germany | 36/59 R |
| 1018130 | 10/1952 | France | 36/59 C |
| 1365430 | 5/1964 | France | 36/59 C |
| 2462882 | 3/1981 | France | 36/59 R |

*Primary Examiner*—Werner H. Schroeder
*Assistant Examiner*—Tracy S. Graveline
*Attorney, Agent, or Firm*—Banner, Birch, McKie & Beckett

[57] ABSTRACT

The invention relates to an outer sole for an athletic shoe. The outer sole has a plurality of ridges of varying depth and cleats to provide traction, cushioning and wearability. The outer sole also includes a serpentine, extended ledge of varying depth in areas where large forces are imparted to the outer sole.

43 Claims, 7 Drawing Figures

ATHLETIC SHOE WITH RIDGED OUTSOLE

TECHNICAL FIELD

This invention relates to shoes, and in particular, to outsoles used on athletic shoes.

BACGROUND OF THE INVENTION

The modern athletic shoe is a combination of many elements which have specific functions, all of which must work together for the support and protection of the foot during an athletic event. The design of an athletic shoe has become a highly refined science. No longer do athletes and participants in sports events use a pair of "sneakers" for all sports. Athletic shoes today are as varied in design and purpose as are the rules for the sports in which the shoes are worn. Tennis shoes, racquetball shoes, basketball shoes, running shoes, baseball shoes, football shoes, weightlifting shoes, etc., are all designed to be used in very specific, and very different, ways. They are also designed to provide a unique and specific combination of traction, support, and protection to enhance athletic performance. Not only are shoes designed for specific sports, they are also designed to meet the specific characteristics of the user. For example, athletic shoes are designed differently for heavier persons than for lighter persons; differently for wide feet than for narrow feet; differently for feet with high archs than for feet with low archs; etc. Some shoes are designed to correct physical problems, such as over pronnation, while others include devices, such as ankle supports, to prevent physical problems from developing.

An athletic shoe is divided into two general parts, an upper and a sole. The upper is designed to snugly and comfortably enclose the foot. In a running or jogging shoe, the upper typically will have several layers, including a weather and wear resistant outer layer of leather or synthetic material such as nylon, and a soft padded inner liner for foot comfort. Current uppers typically have an intermediate layer of a synthetic foam material. The three layers of the upper may be fastened together by stitching, gluing or a combination of these. In areas of maximum wear or stress, reinforcements of leather and/or plastic are attached to the upper. Two examples of such reinforcements are leather toe sections attached over synthetic inner layers of the toe area, and heel counters made of an inner layer of plastic and an outer layer of leather.

The other major portion of the athletic shoe is the sole. The sole must provide traction, protection, and a durable wear surface. The considerable forces generated by running require that the sole of a running shoe provide enhanced protection and shock absorption for the foot and leg. Accordingly, the sole of a running shoe typically includes several layers, including a resilient, energy-absorbant material as a midsole and a ground contacting outer sole or outsole, which provides durability, cushioning and traction. This is particularly true for training or jogging shoes designed to be used over long distances and over a long period of time. The sole also provides a broad, stable base to support the foot during ground contact.

In the design and construction of prior art outer soles for athletic shoes, traction and durability have been the primary factors given consideration. While these factors are important, other performance factors, such as lightweight, flexibility, and enhanced foot dynamics, merit greater emphasis than has been accorded them by the prior art. Moreover, since the outer sole constitutes about one-third of the total weight of the shoe, it is important to maximize its contribution to comfort, performance, support and protection of the foot.

The broad concepts of using cleats and ridges for improved traction and comfort in a running shoe are disclosed in the prior art. However, the prior art does not disclose the combination of features described and claimed herein which provide a lightweight, flexible but durable outer sole which enhances running efficiency.

SUMMARY OF THE INVENTION

The present invention is directed to a lightweight flexible outer sole for an athletic shoe. The outer sole comprises a base member formed of resilient material. The base member is divided into four major sectons: a heel section; an arch section; a forefoot section; and a toe section. The base member has an upper surface, which will be attached to a shoe upper or a midsole, and a lower surface, which will contact the ground during use. A plurality of traction members or ridges for providing traction and cushioning extend downwardly from the lower surface of the base member. The ridges are transverse to the lengthwise direction of the base member and are spaced from one another in the lengthwise direction of the base member with spaces between adjacent ridges. Each of the ridges is of a uniform width. A second traction member, in the form of a cleat, is placed at the lateral, or outside, end of a plurality of the ridges. These lateral cleats are integrally formed with the ridges.

In the preferred embodiment, each ridge and cleat is the same depth, that is, they extend downwardly from the lower surface of the base member by the same amount or distance. Preferably, each of the four major sections of the outer sole, that is the heel section, the arch section, the forefoot section and the toe section, have a plurality of ridges in each section.

In the preferred embodiment, the depth of the ridges and cleats varies among the sections: the depth of the ridges in the arch section is less than the depth of the ridges in the forefoot section; and the depth of the ridges in the forefoot section is less than the depth of the ridges in the heel section. The ridges in each of these three major sections has a different depth which serves a specific function, as will be fully explained below. In the preferred embodiment, the depth of adjacent ridges in the heel section decreases in the longitudinal direction of the shoe's outer sole, that is from the back of the heel section towards the front of the shoe. This decrease in height of ridges in the heel section from back to front of the section aids roll of from the heel and contributes to the formation of a heel lift. In all other sections of the outer sole, the depth of the ridges in that section is constant.

In a preferred embodiment, at least one of the ridges in the heel section is wider than any other of the ridges on the outer sole. This wider ridge in effect serves as a first wear plug or heel stabilizer to help increase wear life of the sole in the heel area and to aid rearfoot stability. A second of the ridges in the heel section may also be used as a second wear plug. The second wear plug is located in front of the first wear plug and has a width less than that of the first wear plug, but greater than that of any other of the ridges on the outer sole. Preferably, both the first and second wear plugs are longitudinally divided to enhance flexibility of the outer sole in the heel section. The remainder of the ridges in the heel section include a transversely elongated cleat integrally formed with each of the remaining ridges in the heel section and located along the lateral edge of the outer sole.

In a preferred embodiment, the lateral cleat referred to above is integrally formed with a plurality of ridges in at least the forefoot section. A second lateral cleat may be located between adjacent ridges in the forefoot section. These second lateral cleats and the ridges in the forefoot section are of a uniform depth. Also, a third cleat may be used in areas of greater load in the forefoot section. The third cleat is preferably integrally formed with each of the ridges of the forefoot section and also is of the same depth as the ridges and the first and second lateral cleats.

In a preferred embodiment, the ridges in the forefoot section are angled rearwardly as the ridges traverse the base member from the lateral to the medial side. The preferred angle, measured from a straight longitudinal line bisecting the heel section, is 10°. It has been found that this angle maximizes traction during toe off, especially while racing.

The base member of the outer sole may also include an extended ledge on the base member, i.e., an extended area along the base member that is thicker than other areas of the base member, which varies in depth and shape according to the load exerted at particular locations along the lengthwise direction of the outer sole. The ledge is designed to fllow the force pattern imparted to the foot at all phases of ground contact, from impact strike of the heel upon the ground to toe-off. Thus, the ledge gradually decreases in depth from the heel section to the arch section and gradually increases in depth from the arch section to the forefoot section and then gradually decreases in depth from the forefoot section to the toe section. The ledge is coplanar with the lower surface of the base member within the arch section, that is, the depth of the ledge decreases to the level of the base member in the arch section. Stated in other terms, there is no ledge in the arch section. In accommodating the forces imparted to the foot during running, the ledge has a serpentine shape, flowing from the lateral side of the heel section to the medial side of the toe section. The ledge does not, however, extend across the entire width of the base member.

Various advantages and features of novelty which characterize the invention are pointed out with particularity in the claims. However, for better understanding of the invention, its advantages, and objects obtained by it use, reference should be had to the drawings and to accompanying descriptive matter in which there is illustrated and described a preferred embodiment of the invention.

DETAILED DESCRIPTION OF THE INVENTION

Figure 1:
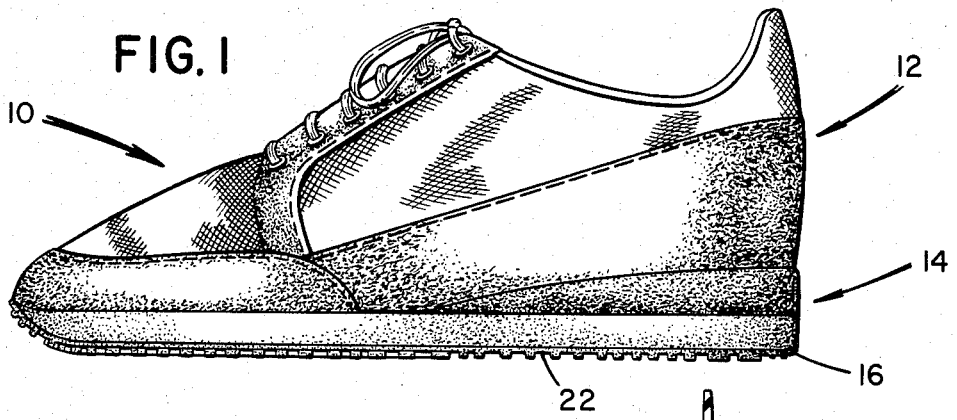
FIG. 1 is a side elevational view of an athletic shoe having an outer sole in accordance with the present invention.

Referring to the drawings in detail, wherein like numerals indicate like elements, there is shown in FIG. 1 an athletic shoe in accordance with the present invention designated generally as 10. Shoe 10 includes shoe upper 12 to which multilayered sole 14 is secured. Multilayered sole 14 includes an outer sole 16, preferably made of a hard, resilient and flexible wear resistant material such as rubber or a comparable synthetic material. The entire outer sole 16, as seen in FIG. 2, is preferably made of a single, integral piece of material.

Outer sole 16 has a base member 18 extending over the entire area of outer sole 16. Base member 18 has an upper surface 20 which is attached to the next sole layer or to the upper and a lower surface 22 which faces the ground when shoe 10 is being worn. Outer sole 16 has a plurality of ridges 24 for providing traction and cushioning. The ridges extend downwardly from the lower surface 22 of base member 18. Ridges 24 extend tranverse of the lengthwise direction of base member 18 as shown in FIG. 2. Ridges 24 are spaced from one another in a lengthwise direction of base member 18 and accordingly are separated by spaces 26. Each of ridges 24 has a substantially uniform width which is substantially less than its length in the transverse direction so that ridges 24 are relatively narrow, elongate bars.

Sole 16 and base member 18 can be divided into four sections which relate to four areas of the foot. These sections also braodly define relative load areas on the sole which occur during normal running. Lines $L_1$, $L_2$ and $L_3$ in FIG. 2 generally delineate the four sections of sole 16. The area forward of line $L_1$ is referred to as the toe section. The area between lines $L_1$ and $L_2$ is referred to as the forefoot section. The area between lines $L_2$ and $L_3$ is referred to as the arch section and the area rearward of line $L_3$ is referred to as the heel section. The lengthwise direction of sole 16 extends between the toe and heel sections.

Figure 2:
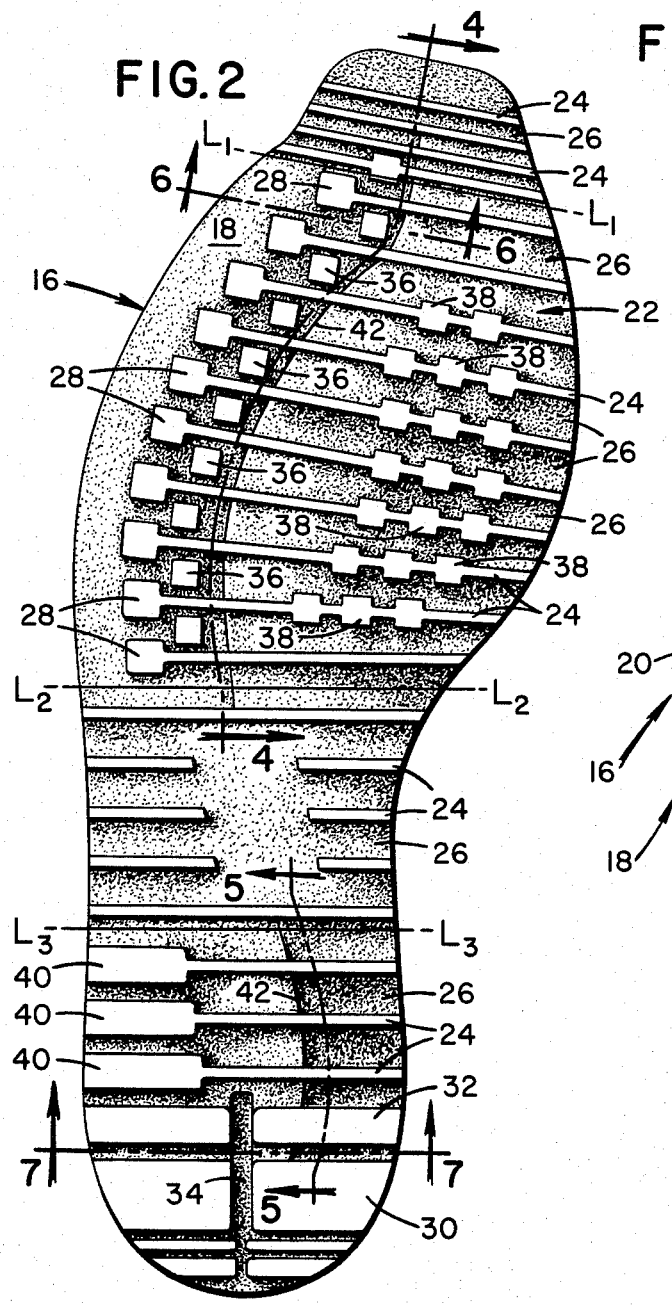
FIG. 2 is a bottom plan view of a sole in accordance with the present invention.
Figure 3:
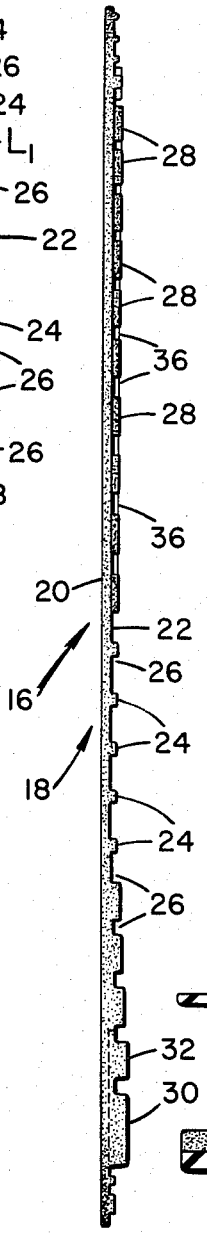
FIG. 3 is a sde plan view of the outer sole shown in FIG. 2.

A lateral cleat 28 is formed at the lateral, or outside, end of a plurality of ridges 24, as shown in FIG. 2. Lateral cleats 28 are integrally formed on the lateral ends of ridges 24. As shown in FIG. 3, ridges 24 and lateral cleats 28 are the same depth. As used herein, the terms "cleat" and "ridge" both refer to traction elements of the base member 18. Cleats 28 are differentiated from ridges 24 in that cleats 28 are a traction element with a widgh greater than that of ridges 24 and cleats 28 have a length which is substantially the same as their width.

In a preferred embodiment, each of the four major sections of outer sole 16, that is, the heel section, the arch section, the forefoot section and the toe section have a plurality of ridges 24 running across or transverse to the lengthwise direction of base member 18.

Ridges 24 in the toe section, the forefoot section, the arch section and the heel section are of varied depths, that is, each section has ridges of different depth and a specific function, but the ridges within each section, except the heel section, are of uniform depth.

The ridges of the heel section have the greatest depth. This added depth adds additional heel lift in the shoe. This lift can aid in Achille's tendon relief which may be somewhat limited, especially in racing shoes, which use a lower heel lift in the midsole in order to reduce weight. The added depth in the heel section also helps increase the wear life of the sole in the heel area.

The arch section has the lowest ridges, as shown in FIG. 3. These low ridges 24 help to reduce weight in the arch area where least support is needed and where least wear takes place. Additionally, the reduced depth of ridges 24 in the arch section creates a "bridge" effect in the arch which helps the forefoot penetrate deeper to achieve better traction.

The forefoot section ridges are of an intermediate depth between that of the heel section and the arch section. This is to aid in maximum wear and traction. Another effect of the depth differences from heel to forefoot is a smoother, quieter transfer from heel plant to toe-off. A perfectly flat sole has a tendency to have a noisey slapping effect while running.

In the forefoot section, cleats are incorporated in the high wear areas of the forefoot, both medially and laterally. A second lateral cleat 36 is located near the lateral edge of base member 18 in the space 26 between adjacent ridges 24. Cleat 36 is the same depth as ridges 24. The outsole of the present invention may also include third cleats 38. Cleats 38 are placed in areas of greater load of the forefoot section, generally in the area of the ball of the foot. Cleats 38 are integrally formed with each of the ridges 24 in the forefoot section. More than one cleat 38 may be integrally formed with each of the ridges 24, with the placement and number of cleats 38 depending upon the load in the forefoot section. A preferred placement and number of cleats 38 is illustrated in FIG. 2 wherein two or three cleats 38 are placed on substantially all of ridges 24 in the forefoot section under the area of the ball of the foot. In the preferred embodiment, ridges 24 in the forefoot section are angled rearwardly as the ridges traverse the base member from the lateral to the medial side. The preferred angle, measured from a straight longitudinal line bisecting the heel section, is 10°. This angle has been determined to be the angle which achieves maximum traction during toe-off, particularly while racing.

The toe section includes ridges of reduced size which aid toe-off and increase wear in the toe section.

The ridges in the heel section decrease in depth from the rear of the heel section beginning at wear plug 30 towards the front of the heel section, as shown in FIG. 3. This decreasing depth aids roll-off from the heel.

Figure 7:
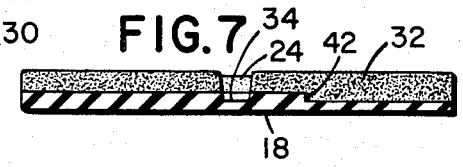
FIG. 7 is a sectional view taken generally along lines 7—7 of FIG. 2.

Two of ridges 24 in the heel section are modified to constitute first and second wear plugs 30 and 32, respectively. Wear plug 30 is wider than any other of the ridges 24. This widened ridge or wear plug helps to increase wear in the heel section and aids rearfoot stability. Immediately forward of wear plug 30 is a second wear plug 32. In the heel section, ridges 24 forward of wear plug 32 have a transversely elongated cleat 40 integrally formed on the lateral end thereof and extending to the lateral edge of base member 18. Wear plus 32 has a width less than that of wear plug 30 but greater than that of any other ridge 24. As shown in FIGS. 2 and 7, wear plugs 30 and 32 are longitudinally divided as shown at 34 to increase flexibility of base member 18 in the heel section.

The outsole of the present invention may include an extended ledge 42 which varies in depth and shape according to the load exerted at particular locations along the lengthwise direction of base member 18. Extended ledge 42 is preferably formed as selective areas of base member 18 which are thicker than other areas of base member 18. Ledge 42 gradually decreases in depth from the heel section to the arch section; gradually increases in depth from the arch section to the forefoot section; and then gradually decreases in depth from the forefoot section to the toe section. The thickness of the ledge in the arch section diminishes to zero, that is, the ledge is coplanar with the lower surface 22 of base member 18 in the arch section.

The shape of the ledge follows the pattern of forces imparted to the foot during running. At the beginning of footstrike, the forces are usually greatest on the lateral side of the heel and generally decrease towards the midfoot. The forces then increase on the medial side of the forefoot area. These forces are not linear but tend to follow a serpentine path. Thus, the ledge 42 is a serpentine shape as shown in FIG. 2, flowing from the lateral, or outside, edge of the heel section to the medial, or inside, edge of the toe section. Ledge 42 does not extend across the entire width of base member 18, as shown in FIG. 2, because the forces imparted to the foot on the medial side of the heel section and the lateral side of the forefoot section are significantly less than on other parts of the foot and thus do not need the additional cushioning, support and wearability provided by ledge 42.

Figure 4:
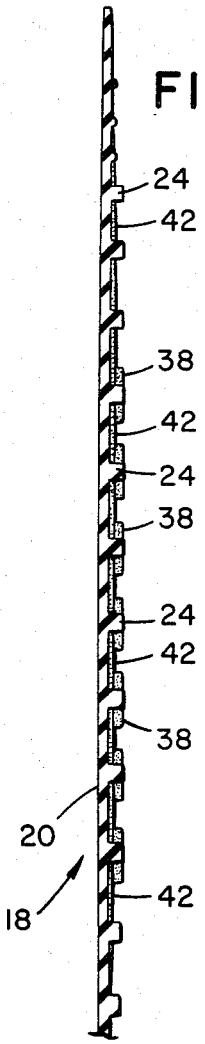
FIG. 4 is a sectional view taken generally along lines 4—4 of FIG. 2.
Figure 5:
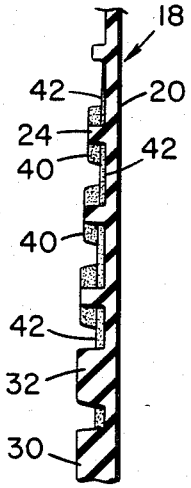
FIG. 5 is a sectional view taken generally along lines 5—5 of FIG. 2.
Figure 6:
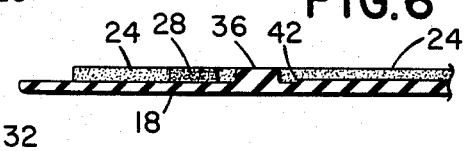
FIG. 6 is a sectional view taken generally along lines 6—6 of FIG. 2.

As shown in FIG. 5, ledge 42 gradually decreases in depth as it progresses from the rear to the front of the heel section. The ledge gradually increases in depth from the rear to the front of the forefoot section as shown in FIG. 4.

Numerous characteristics and advantages of the invention have been set forth in the foregoing description, together with details of the structure and functions of the invention. The disclosure, however, is illustrative only, and changes may be made in detail, especially in matters of shape, size and arrangement of parts within the principle of the invention to the full extent indicated by the broad general meaning of the terms in which the appended claims are expressed.

I claim:

1. A lightweight flexible outer sole for an athletic shoe comprising:

a base member formed of resilient material and having a heel section, an arch section, a forefoot section and a toe section, said base member having an upper surface for attachment to another member and a lower surface;

a plurality of ridges for providing traction and cushioning extending downwardly from the lower surface of said base member and transverse to the lengthwise direction thereof, said ridges being spaced from one another in the lengthwise direction of said base member and separated by spaces, each of said ridges being of uniform width;

a first lateral cleat at the lateral end of a plurality of said ridges, said lateral cleat integrally formed with said ridges; and a second lateral cleat between adjacent ridges in said forefoot section, said second lateral cleats and said ridges in said forefoot section being the same depth.

2. An outer sole as recited in claim 1 wherein said ridges and said cleats are the same depth.

3. An outer sole as recited in claim 2 wherein each of said heel section, said arch section, said forefoot section, and said toe section has a plurality of said ridges.

4. An outer sole as recited in claim 3 wherein said ridges in said forefoot section have a lateral cleat at the end thereof.

5. An outer sole as recited in claim 4 further comprising at least one third cleat in areas of greater load of said forefoot section, said third cleat being integrally formed with said ridges in said forefoot section.

6. An outer sole as recited in claim 3 wherein the depth of said ridges in said arch section is less than the depth of said ridges in said forefoot section and the depth of said ridges in said forefoot section is less than the depth of said ridges in said heel section.

7. An outer sole as recited in claim 3 further comprising a first wear plug in said heel section.

8. An outer sole as recited in claim 7 further comprising a second wear plug in said heel section, said second wear plug being in front of said first wear plug, and said second wear plug having a width less than said first wear plug.

9. An outer sole as recited in claim 8 wherein said first and second wear plugs are longitudinally divided.

10. An outer sole as recited in claim 3 wherein the depth of adjacent ridges in said heel section decreases in the longitudinal direction from the rearmost ridge forward.

11. An outer sole as recited in claim 10 wherein a transversely elongated cleat is integrally formed with at least one of said ridges in said heel section.

12. An outer sole as recited in claim 3 wherein said ridges in said forefoot section are angled rearwardly as said ridges traverse from the lateral to the medial side of said base member.

13. An outer sole as recited in claim 12 wherein said angle is 10° with respect to a straight longitudinal line bisecting said heel section.

14. An outer sole as recited in claim 3 wherein said ledge gradually decreases in depth from said heel section to said arch section, gradually increases in depth from said arch section to said forefoot section, and gradually decreases in depth from said forefoot section to said toe section.

15. An outer sole as recited in claim 14 wherein said ledge is coplanar with the lower surface of said base member in the arch section.

16. An outer sole as recited in claim 14 wherein said ledge is a serpentine shape flowing from the lateral side of said heel section to the medial side of said toe section.

17. An outer sole as recited in claim 16 wherein in said heel section said ledge extends transverse to the lenghtwise direction of said base member from the lateral edge of said heel section to a position spaced from the medial edge of said heel section, and wherein in said toe section and said forefoot section said ledge extends transverse to the lenghtwise direction of said base member from the medial edge of said toe and forefoot sections to a position spaced from the lateral edge of said toe and forefoot sections.

18. A lightweight flexible outer sole for an athletic shoe comprising:

a base member formed of resilient material and having a heel section, an arch section, a forefoot section and a toe section, said base member having an upper surface for attachment to another member and a lower surface;

a plurality of ridges in each of said heel section, said arch section, said forefoot section, and said toe section for providing traction and cushioning extending downwardly from the lower surface of said base member and transverse to the lengthwise direction thereof, said ridges being spaced from one another in the lenghtwise direction of said base member and separated by spaces, each of said ridges being of uniform width;

a lateral cleat at the lateral end of said ridges in said forefoot section, said lateral cleat integrally formed with said ridges, and said ridges being the same depth as said cleats;

the depth of said ridges in said arch section being less than the depth of said ridges in said forefoot section and the depth of said ridges in said forefoot section being less than the depth of said ridges in said heel section; and a first wear plug in said heel section.

19. An outer sole as recited in claim 18 further comprising:

a second wear plug in said heel section, said second wear plug being in front of said first wear plug, and said second wear plug having a width less than said first wear plug; and a second lateral cleat between adjacent ridges in said forefoot section, said second lateral cleats and said ridges in said forefoot section being the same depth.

20. An outer sole as recited in claim 19 wherein said ridges in said forefoot section are angled rearwardly as said ridges traverse from the lateral to the medial side of said base member; and further comprising at least one third cleat in areas of greater load of said forefoot section, said third cleat being integrally formed with said ridges in said forefoot section.

21. An outer sole as recited in claim 19 wherein a transversely elongated cleat is integrally formed with at least one of said ridges in said heel section and wherein said first and second wear plugs are longitudinally divided.

22. A lightweight flexible outer sole for an athletic shoe comprising:

a base member formed of resilient material and having a heel section, an arch section, a forefoot section and a toe section, said base member having an upper surface for attachment to another member and a lower surface;

a plurality of traction elements for providing traction and cushioning extending downwardly from the lower surface of said base member; and an extended ledge on said base member, said ledge gradually decreasing in depth from said heel section to said arch section, gradually increasing in depth from said arch section to said forefoot section, and gradually decreasing in depth from said forefoot section to said toe section.

23. A lightweight flexible outer sole as recited in claim 22 wherein said ledge is coplanar with the lower surface of said base member in said arch section.

24. A light weight flexible outer sole as recited in claim 23 wherein in said heel section said ledge has its greatest depth at the rear of said heel section, and in said forefoot section said ledge has its greatest depth under the metatarsal area of the forefoot.

25. A lightweight flexible outer sole as recited in claim 22 wherein said ledge is a serpentine shape flowing from the lateral side of said heel section to the medial side of said toe section.

26. A lightweight flexible outer sole as recited in claim 25 wherein said ledge extends less than the full transverse width of said base member.

27. An outer sole as recited in claim 22 wherein in said heel section said ledge extends transverse to the lengthwise direction of said base member from the lateral edge of said heel section to a position spaced from the medial edge of said heel section, and wherein in said toe section and said forefoot section said ledge extends transverse to the lengthwise direction of said base member from the medial edge of said toe and forefoot sections to a position spaced from the lateral edge of said toe and forefoot sections.

28. An athletic shoe comprising:

a shoe upper;

a sole secured to said upper;

said sole including a lightweight, flexible outer sole haivng a base member formed of resilient material, said base member having a heel section, an arch section, a forefoot section, a toe section, and a lower surface;

a plurality of ridges for providing traction and cushioning extending downwardly from the lower surface of said base member and transverse to the lengthwise direction thereof, said ridges being spaced from one another in the lengthwise direction of said base member and separated by spaces, each of said redges being of uniform width;

a first lateral cleat at the lateral end of a plurality of said ridges, said lateral cleat integrally formed with said ridges; and a second lateral cleat between adjacent ridges in said forefoot section, said second lateral cleats and said ridges in said forefoot section being the same depth.

29. A shoe as recited in claim 28 wherein said ridges and said lateral cleats are the same depth.

30. A shoe as recited in claim 29 wherein each of said heel section, said arch section, said forefoot section, and said toe section has a plurality of said ridges.

31. A shoe as recited in claim 30 further comprising an extended ledge on said base member, said ledge varying in depth and shape according to the load exerted at particular locations along the lengthwise direction of said outer sole.

32. A shoe as recited in claim 31 wherein said ledge gradually decreases in depth from said heel section to said arch section, gradually increases in depth from said arch section to said forefoot arch section, and gradually decreases in depth from said forefoot section to said toe section.

33. A shoe as recited in claim 32 wherein said ledge is a serpentine shape flowing from the lateral side of said heel section to the medial side of said toe section and wherein said lateral cleats and said second lateral cleats follow the serpentine shape of said ledge in said forefoot section.

34. A shoe as recited in claim 32 wherein said ledge is coplanar with the lower surface of said base member in said arch section.

35. A shoe as recited in claim 30 further comprising at least one third cleat in areas of greater load of said forefoot section, said third cleat being integrally formed with each of said ridges in said forefoot section.

36. A shoe as recited in claim 30 wherein the depth of said ridges in said arch section is less than the depth of said ridges in said forefoot section, and the depth of said ridges in said forefoot section is less than the depth of said ridges in said heel section.

37. A shoe as recited in claim 36 further comprising a first wear plug in said heel section.

38. A shoe as recited in claim 37 further comprising a second wear plug in said heel section; said second wear plug being in front of said first wear plug, and said second wear plug having a width less than said first wear plug.

39. A shoe as recited in claim 38 wherein said first and second wear plugs are longitudinally divided.

40. A shoe as recited in claim 36 wherein the depth of adjacent ridges in said heel section decreases in the longitudinal direction.

41. A shoe as recited in claim 40 wherein a transversely elongated cleat is integrally formed with at least one of said ridges in said heel section.

42. A shoe as recited in claim 30 wherein said ridges in said forefoot section are angled rearwardly as said ridges traverse from the lateral to the medial side of said base member.

43. A shoe as recited in claim 42 wherein said angle is 10° with respect to a straight longitudinal line bisecting said heel section.

* * * * *